US006382155B2

(12) United States Patent
Simpson

(10) Patent No.: US 6,382,155 B2
(45) **Date of Patent: *May 7, 2002**

(54) VARIABLE VALVE TIMING WITH ACTUATOR LOCKING FOR INTERNAL COMBUSTION ENGINE

(75) Inventor: Roger T. Simpson, Ithaca, NY (US)

(73) Assignee: BorgWarner Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/874,663

(22) Filed: Jun. 5, 2001

Related U.S. Application Data

(63) Continuation of application No. 09/450,456, filed on Nov. 29, 1999, now Pat. No. 6,250,265.
(60) Provisional application No. 60/141,931, filed on Jun. 30, 1999.

(51) Int. Cl.[7] ..... F01L 1/344
(52) U.S. Cl. ..... 123/90.17
(58) Field of Search ..... 123/90.15, 90.17, 123/90.31

(56) References Cited

U.S. PATENT DOCUMENTS

| | | | |
|---|---|---|---|
| 2,861,557 | A | 11/1958 | Stolte |
| 4,858,572 | A | 8/1989 | Shirai et al. |
| 5,056,477 | A | 10/1991 | Linder et al. |
| 5,107,804 | A | 4/1992 | Becker et al. |
| 5,507,254 | A | 4/1996 | Melchior |
| 5,797,361 | A | 8/1998 | Mikame et al. |
| 5,816,204 | A | 10/1998 | Moriya et al. |
| 5,870,983 | A | 2/1999 | Sato et al. |
| 6,053,138 | A | 4/2000 | Trzmiel et al. |
| 6,058,897 | A | 5/2000 | Nakyoshi |
| 6,079,382 | A | 6/2000 | Schafer et al. |
| 6,085,708 | A | 7/2000 | Trzmiel et al. |
| 6,105,543 | A | 8/2000 | Ogawa |
| 6,129,063 | A | 10/2000 | Niethammer et al. |

FOREIGN PATENT DOCUMENTS

| | | |
|---|---|---|
| DE | 19755495 A1 | 6/1999 |
| EP | 0924391 A2 | 6/1999 |
| EP | 0924392 A2 | 6/1999 |
| EP | 0924393 A2 | 6/1999 |

*Primary Examiner*—Weilun Lo
(74) *Attorney, Agent, or Firm*—Emch, Schaffer, Schaub & Porcello & Co., L.P.A.; Greg Dziegielewski

(57) ABSTRACT

A variable camshaft timing system comprising a camshaft (36) with a vane (2) secured to the camshaft for rotation with the camshaft but not for oscillation with respect to the camshaft. The vane has a circumferentially extending plurality of lobes (20, 22, 24) projecting radially outwardly therefrom and is surrounded by an annular housing (28) that has a corresponding plurality of recesses (30, 32, 34) each of which receives one of the lobes and has a circumferential extent greater than the circumferential extent of the lobe received therein to permit oscillation of the housing relative to the camshaft. Oscillation of the housing relative to the camshaft is actuated by pressurized engine oil in each of the recesses on opposed sides of the lobe therein, the oil pressure in such recess being preferably derived in part from a torque pulse in the camshaft as it rotates during its operation. An annular locking plate (50) is positioned coaxially with the camshaft and the annular housing and is moveable relative to the annular housing along a longitudinal central axis of the camshaft between a first position and a second position. The locking plate is biased by a spring (52) toward its first position and is urged away from its first position toward its second position by engine oil pressure when engine oil pressure is sufficiently high to overcome the spring biasing force.

27 Claims, 11 Drawing Sheets

VARIABLE VALVE TIMING WITH ACTUATOR LOCKING FOR INTERNAL COMBUSTION ENGINE

CROSS REFERENCE TO RELATED APPLICATIONS

This application is based, in part, on provisional application No. 60/141,931, which was filed on Jun. 30, 1999, and is a continuation of U.S. patent application Ser. No. 09/450,456, which was filed on Nov. 29, 1999, now U.S. Pat. No. 6,250,265.

BACKGROUND OF THE INVENTION

1. Field of the Invention

This invention relates to a variable valve timing system for an internal combustion engine. More particularly, this invention relates to a torque pulse actuated, hydraulic variable valve timing system of the foregoing type with locking capabilities to lock the components of the system in a fixed condition of operation during intervals of low hydraulic pressure, such as during engine start-up.

2. Description of the Prior Art

U.S. Pat. No. 5,107,804 (Becker et al.), which is assigned to the assignee of this application, the disclosure of which is incorporated by reference herein, describes a vane-type, camshaft torque pulse actuated hydraulic camshaft or valve timing system for an internal combustion engine in which the hydraulic fluid that operates the camshaft phase shifting system is engine oil. Such a system has many operating advantages over other known types of valve or camshaft timing systems, for example, in the timeliness of response to changes in engine operating conditions. However, such systems tend to be noisy or otherwise unstable during periods of low engine oil pressure, which can often occur during engine start-up and can occasionally occur during other types of operating conditions. During these times it is important to be able to lock the otherwise relatively movable components of the system into fixed positions relative to one another, and it is to the provision of an improved solution of the system locking requirements of such a variable valve timing system that the present invention is directed and of suitable systems for controlling the operation of such a system.

U.S. Pat. No. 2,861,557 (Stolte) also describes an hydraulic variable camshaft timing system, albeit a system that is operated solely by engine oil pressure. This reference teaches that it is desirable to lock the otherwise variable components of the system in fixed positions relative to one another during low speed operation conditions, but only teaches a system in which only a single set of fixed positions can be achieved.

SUMMARY OF THE INVENTION

A variable valve timing system, of which a variable camshaft timing system is a recognized type, according to the present invention preferably is, like the system of the aforesaid '804 patent, a camshaft torque pulse actuated, engine oil powered hydraulic system that is used to change the position of a lobed vane, albeit a vane with three lobes rather than the two-lobed vane of the '804 patent, within lobe receiving recesses of a surrounding housing. According to the present invention, however, the vane and the housing are locked in fixed positions relative to one another by a locking plate that is spring biased, against the effects of engine oil pressure, to prevent relative motion between the vane and the housing except when the engine oil pressure exceeds a predetermined value, and the locking can occur at one or another of a multitude of positions of the vane and the housing relative to one another. It is also contemplated that the invention can be adapted to a hybrid variable camshaft timing system operated both on engine oil. pressure, and oil pressure resulting from camshaft torque pulses, such as that of U.S. Pat. No. 5,657,725 (Butterfield et al.), which is also assigned to the assignee of this application, the disclosure of which is also incorporated by reference herein, and to an engine oil pressure actuated system such as that of the aforesaid U.S. Pat. No. 2,861,557.

A camshaft torque pulse actuated hydraulic VCT system, or a hybrid system that operates both on engine oil pressure and oil pressure generated by camshaft torque pulses, can be locked in place by the locking arrangement of the present invention, which lends itself to on-off control in various ways, depending on the needs or wishes of the user. First, a solenoid can be employed to control the application of engine oil pressure against the locking place to prevent unlocking of the vane and the housing unless and until the solenoid is de-energized, even when engine oil pressure exceeds the predetermined value. This will permit the relative positions of the vane and the housing to be changed from a given locked position to a different locked position even when the engine oil pressure exceeds the predetermined value. Alternatively, the engine oil pressure can be applied directly against the locking plate, without any attempt to selectively isolate the locking plate from the effects of engine oil pressure, so that the engine timing system will always be operable during periods of high engine oil pressure.

The variable valve timing/variable camshaft timing system of the present invention can also be controlled during operation either by an open loop system or a closed loop system, again depending on the needs or wishes of the user. In an open loop control system, there are only two control positions, either a position where the vane moves at a fixed rate to full advance or a position where the vane moves at the fixed rate to full retard, without any effort to modulate the rate of movement of the vane to its full advance or full retard position, as the case may be, or to stop the movement of the vane at any position in between such full advance and fill retard positions. In a closed loop control system, on the other hand, the position of the vane relative to the housing is monitored and the system is locked at one or another of a multitude of possible relative positions of the vane and the housing between the full advance and full retard positions.

Accordingly, it is an object of the present invention to provide an improved vane-type, torque pulse actuated, hydraulic variable valve timing, or variable camshaft timing system for an internal combustion engine. More particularly, it is an object of the present invention to provide a variable valve timing or variable camshaft timing system of the foregoing character with an improved arrangement for locking a position of a vane relative to a position of a housing in which the vane is normally free to move, whenever engine operating conditions make it desirable to prevent relative motion between the vane and the housing.

It is also an object of the present invention to provide improved control systems for controlling the operating of a variable valve timing or variable camshaft timing system of the foregoing character.

For a further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 1:
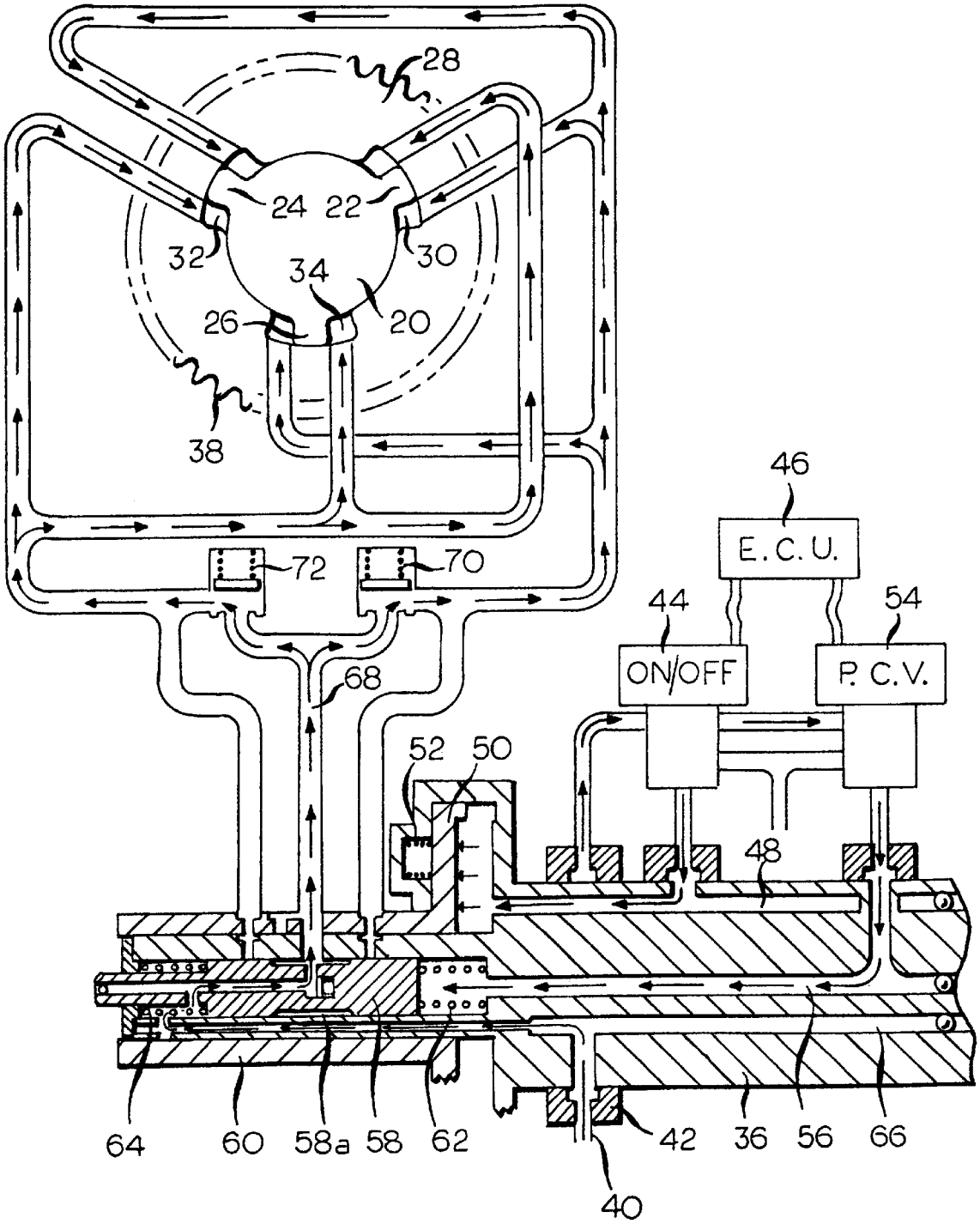
FIG. 1 is a schematic view of the hydraulic equipment of the variable valve timing arrangement according to the preferred embodiment and illustrates a condition where the position of the camshaft is not changing, but is free to change, that is, it is unlocked.

As is shown in FIGS. 1, 3, 5 and 7, a vane 20 of a variable valve timing system according to the preferred embodiment of the present invention is provided with a plurality of radially outwardly projecting lobes, shown as three (3) such lobes 22, 24, 26. An annular housing 28 surrounds the vane 20, and the housing 28 has recesses 30, 32, 34, that receive the lobes 22, 24, 26, respectively. The vane 20 is keyed or otherwise secured to a camshaft 36 of an internal combustion engine so as to be rotatable with the camshaft 36 but not oscillatable with respect to the camshaft 36. The housing 28 is provided with sprocket teeth 38 on an exterior thereof. The assembly that includes the camshaft 36, with the vane 20 and the housing 28, is caused to rotate by torque applied to the housing 28 by an endless chain (not shown) that engages the sprocket teeth 38, and motion is imparted to the endless chain by a rotating crankshaft (not shown) or another rotating camshaft (also not shown). However, the housing 28, which rotates with the camshaft 36 as explained, is oscillatable with respect to the camshaft 36 to change the phase of the camshaft 36 relative to the crankshaft, or to another camshaft. In that regard, the circumferential extent of each of the recesses 30, 32, 34 is greater than the circumferential extent of each of the lobes 22, 24, 26 that is received therein to thereby permit limited relative circumferential motion between the housing 28 and the vane 20.

Figure 3:
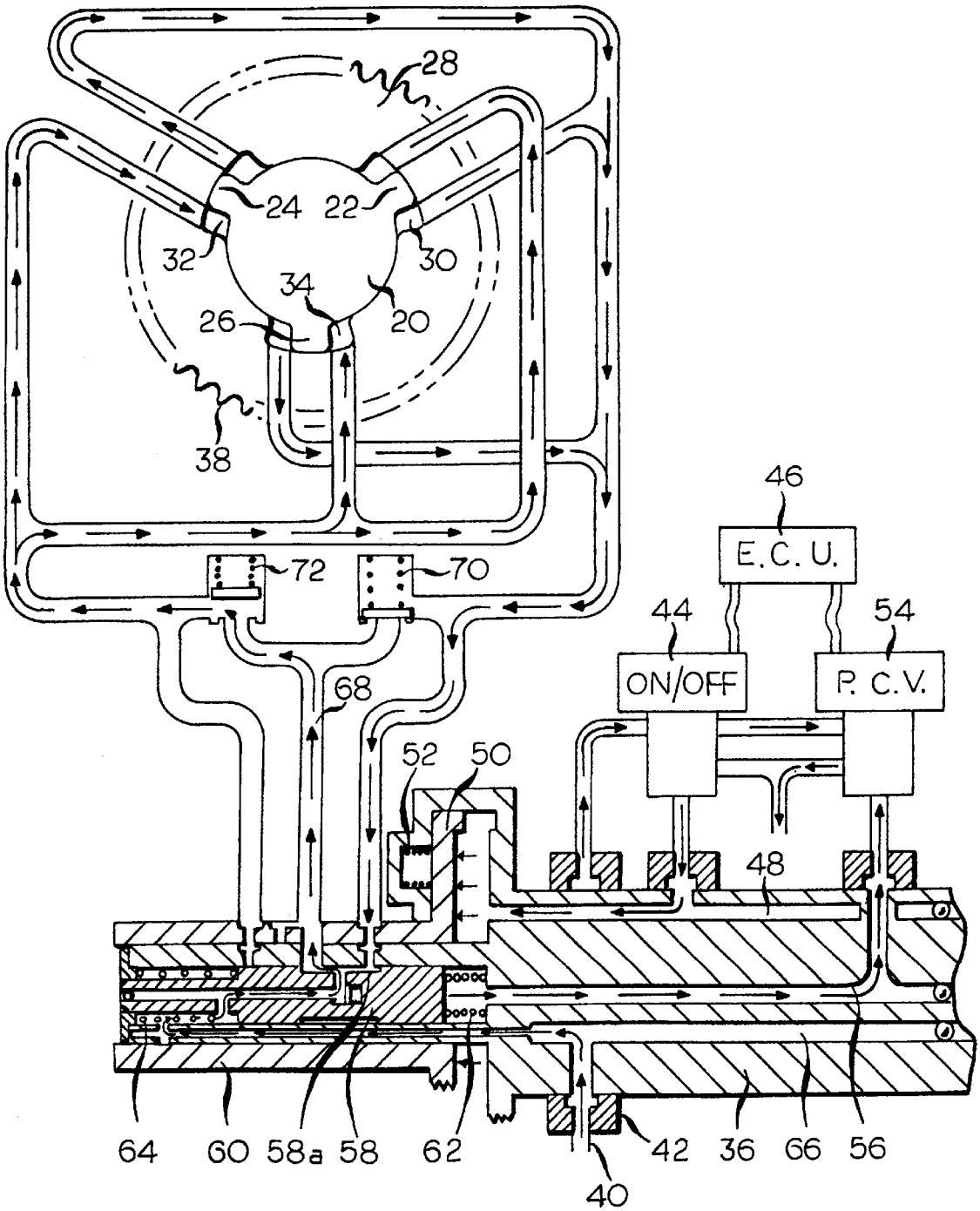
FIG. 3 is a schematic view of the hydraulic equipment of the variable valve timing arrangement according to the present invention during the shifting of the variable valve timing system to its advance position.
Figure 5:
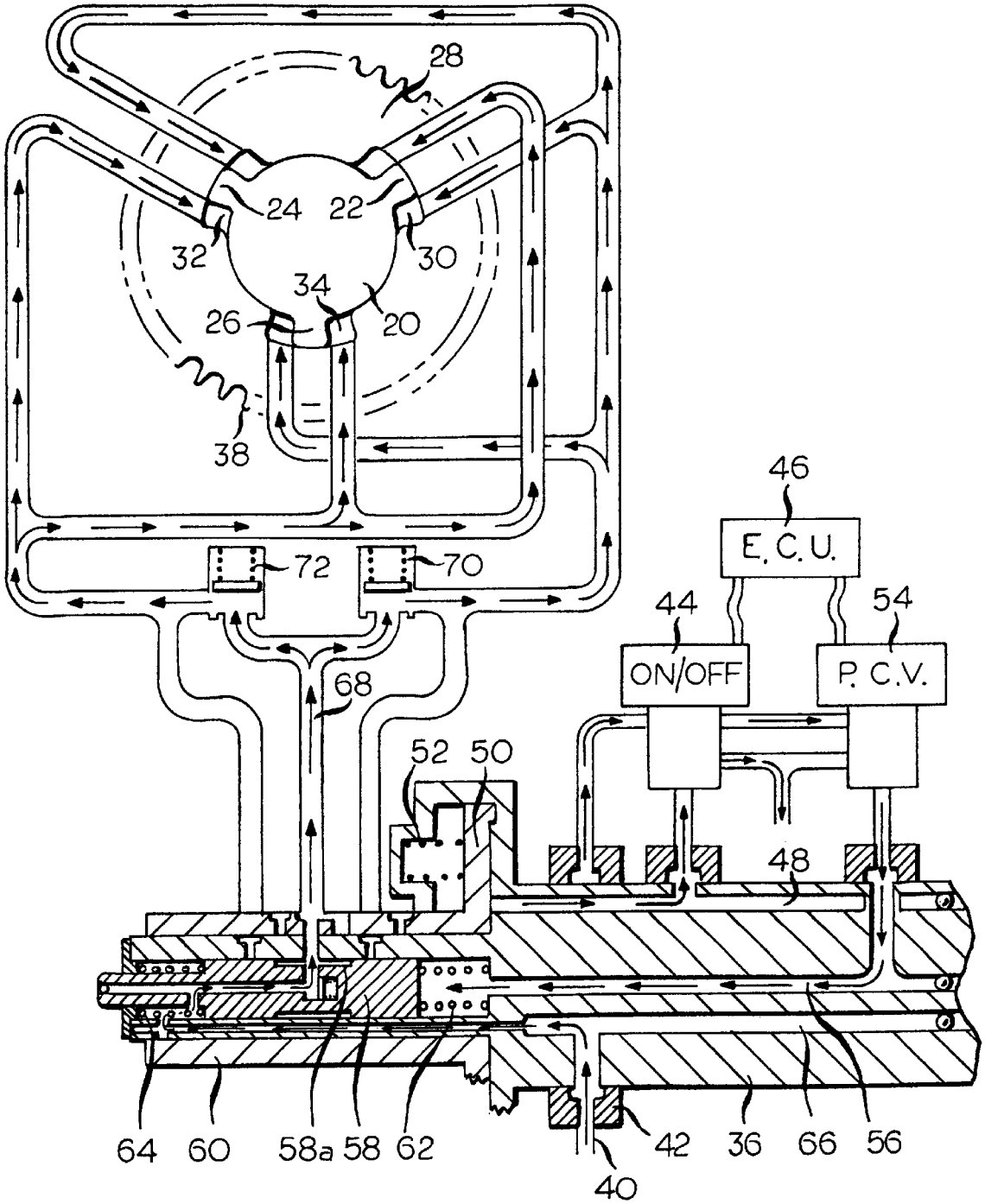
FIG. 5 is a view like FIGS. 1 and 3, illustrating the system in its locked condition in which the elements thereof are maintaining their relative positions.
Figure 7:
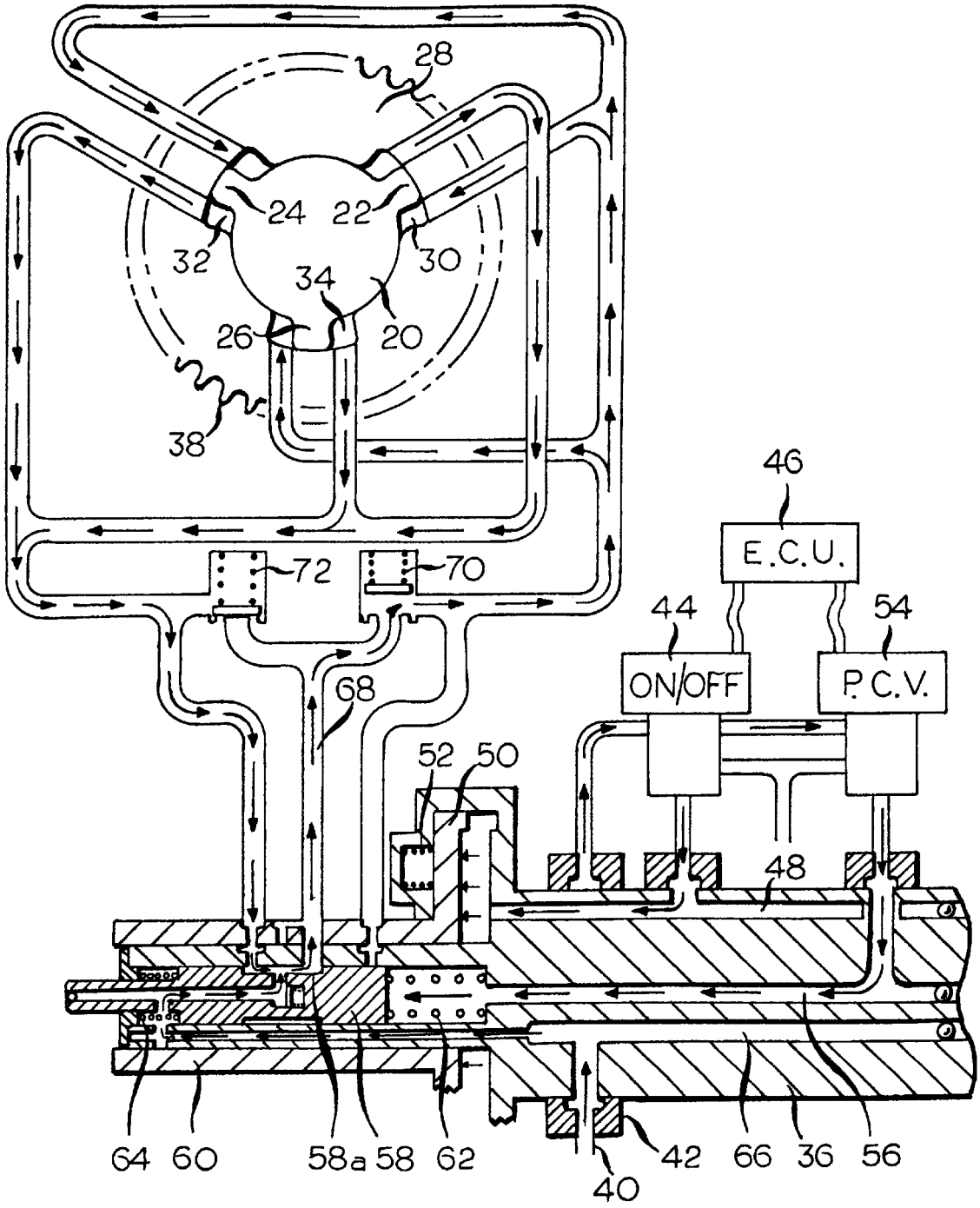
FIG. 7 is a view like FIGS. 1, 3 and 5 illustrating the system during the movement of the components thereof to the retard position.
Figure 8:
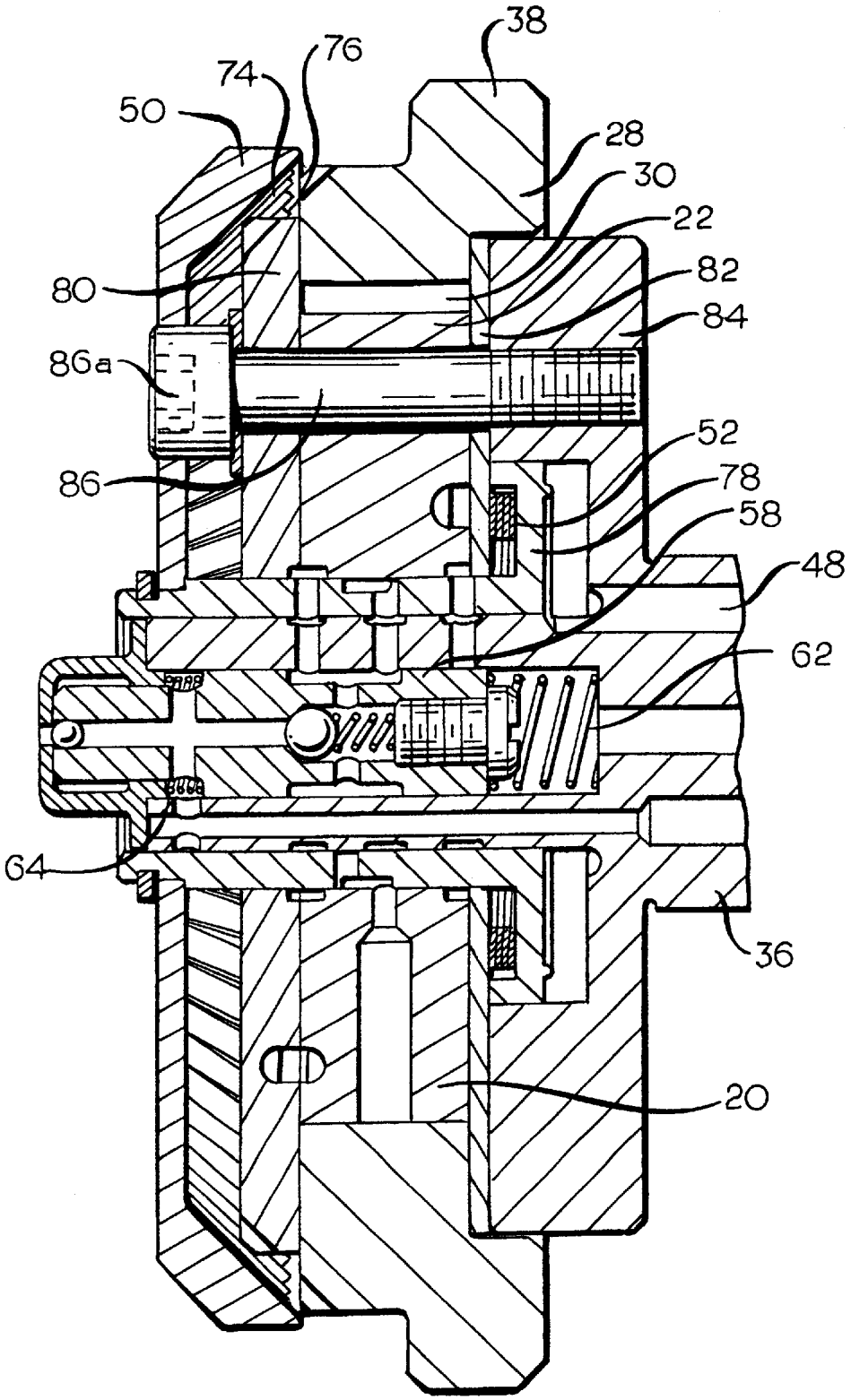
FIG. 8 is a view like FIGS. 2, 4 and 6, of the components of the system during the FIG. 7 condition of the system.
Figure 9:
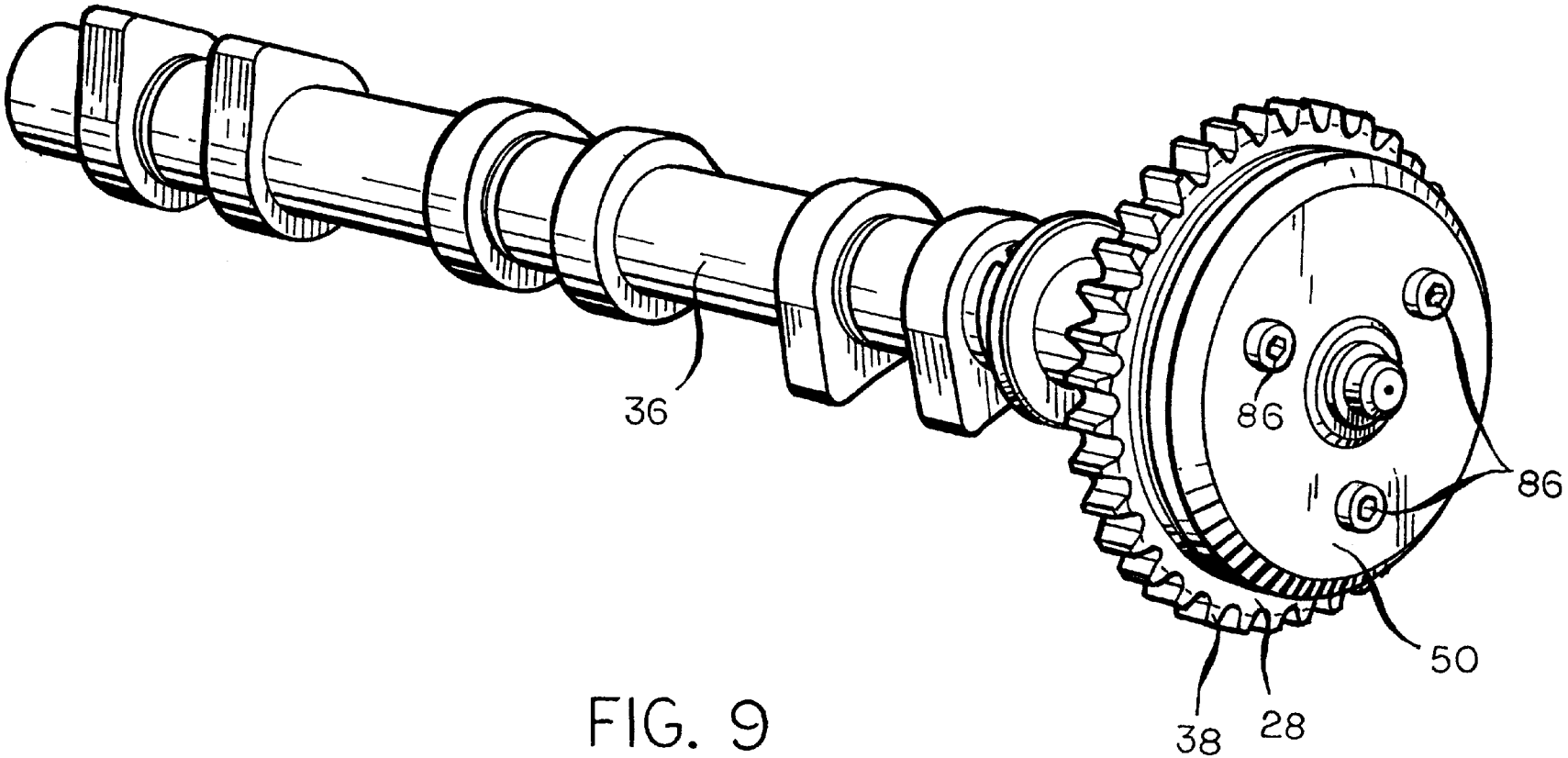
FIG. 9 is a perspective view of a camshaft having a variable valve timing system according to the present invention.

Pressurized engine oil from an engine main oil gallery, not shown, flows into the recesses 30, 32, 34, by way of a passage 40 in a camshaft bearing 42 and flows to an on/off 3-way flow control valve 44, shown schematically, whose operation is controlled by an electronic engine control unit 46. When the on/off valve 44 is on, as is shown in FIGS. 1, 3 and 7, oil flows thorough the valve 44 and a passage 48 in the camshaft 36 against a locking plate 50 to urge the locking plate 50, against the force of a return spring 52, to a position where the locking plate 50 does not lock the housing 28 at a given position relative to the vane 20, by structure that will hereinafter be described in greater detail. In FIG. 5, on the other hand, the on/off valve is off and no engine oil, therefore, will flow into the passage 48, whereupon the return spring 52 will return the locking plate 50 to its locked position.

Pressurized engine oil from the passage 40 also flows, at all times, through the flow control valve 44 into a linear 3-way pressure control valve 54, which is in fluid communication through a passage 56 in the camshaft 36 with an end of a sliding spool 58 in a spool control valve 60. The position of the spool 58 within the spool control valve 60 is adjustable along the longitudinal central axis of the spool 58, and springs 62, 64 act on opposed ends of the spool 58 to urge it to or fro depending on the desired operating conditions of the vane 20 and the housing 28 relative to one another. In that regard, in the FIG. 1 position of the spool 58, it is in its centered or "null" position, with forces on its opposed ends in balance, so that oil from a passage 66 flows through the end of the spool 58 that is acted on by the spring 54, to flow through a reduced diameter portion 60*a* of the spool control valve 60 into an inlet line 68 to the housing 28, from which it flows into the recesses 30, 32, 34 on opposed sides of the lobes 22, 24, 26, respectively, if both check valves 70, 72 are open to flow, a condition which is illustrated in FIG. 1. In the condition illustrated in FIG. 1, with both check valves 70, 72 open, there will be no relative movement between the vane 20 and the housing 28, even in the unlocked position of the locking plate 50. In any case, the check valves 70, 72 serve to prevent reverse flow from the recesses 30, 32, 34 through the inlet line 68 when the pressure in the recesses 30, 32, 34, on one or another of the sides of the lobes, 22, 24, 26, respectively, exceeds the pressure in the inlet line 68, as it will during part of each rotation of the camshaft 36 due to torque pulses in the camshaft 36, as explained in the aforesaid '804 patent.

Figure 2:
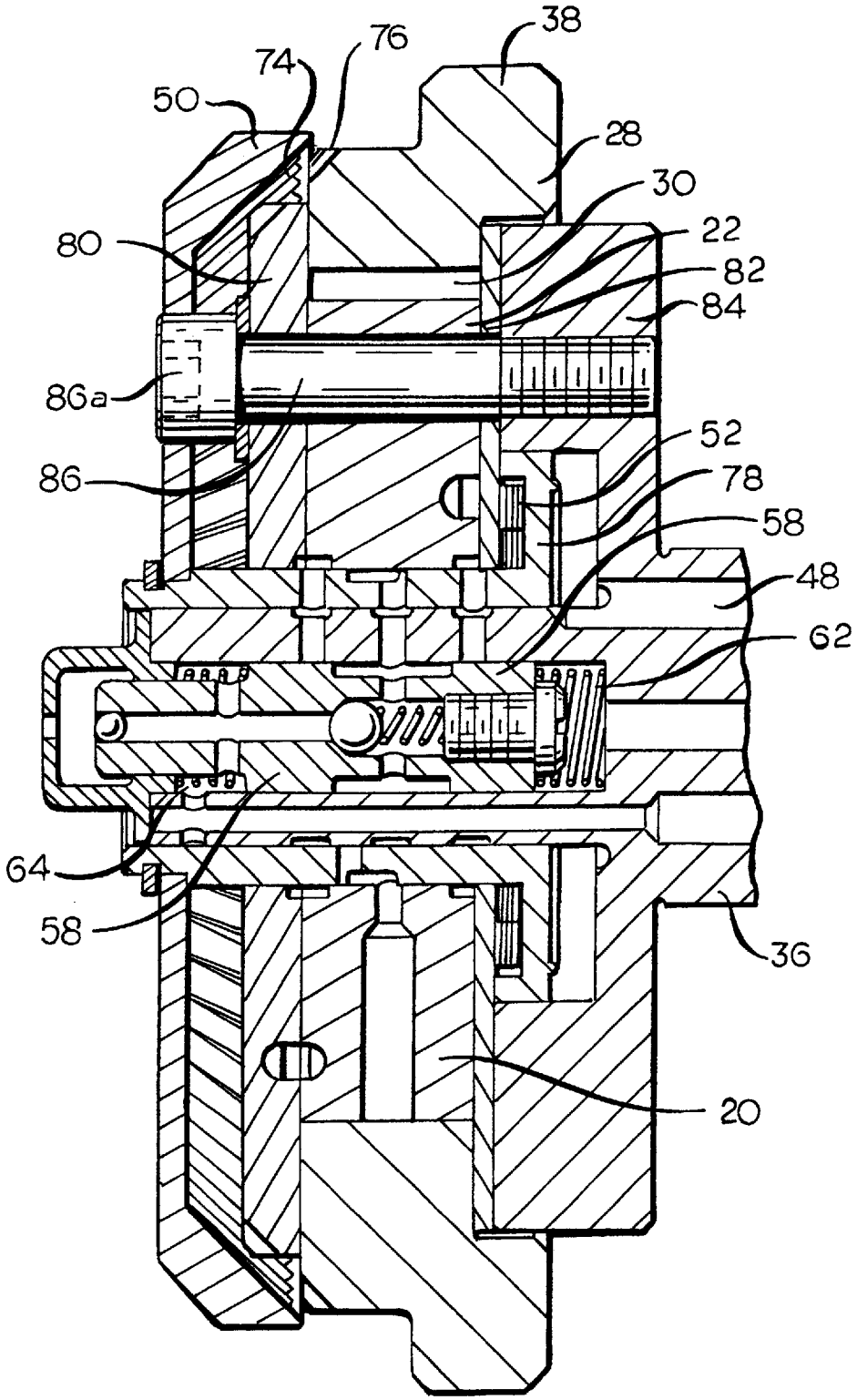
FIG. 2 is a fragmentary elevational view of components of the variable valve timing system of the present invention in the position of such components that is illustrated in FIG. 1.
Figure 4:
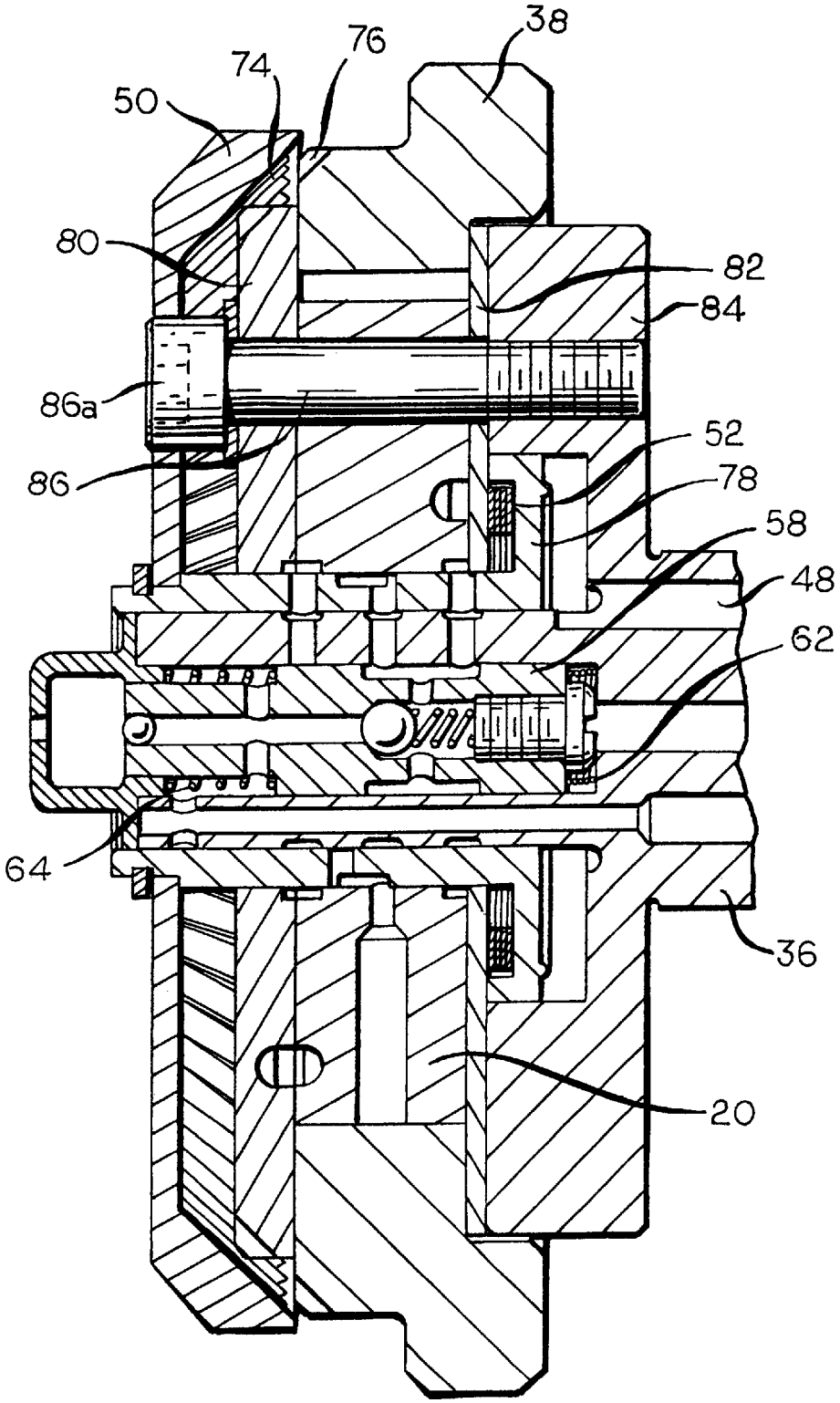
FIG. 4 is a view, like FIG. 2, of the components of the system in the FIG. 3 condition of operation of the system.
Figure 6:
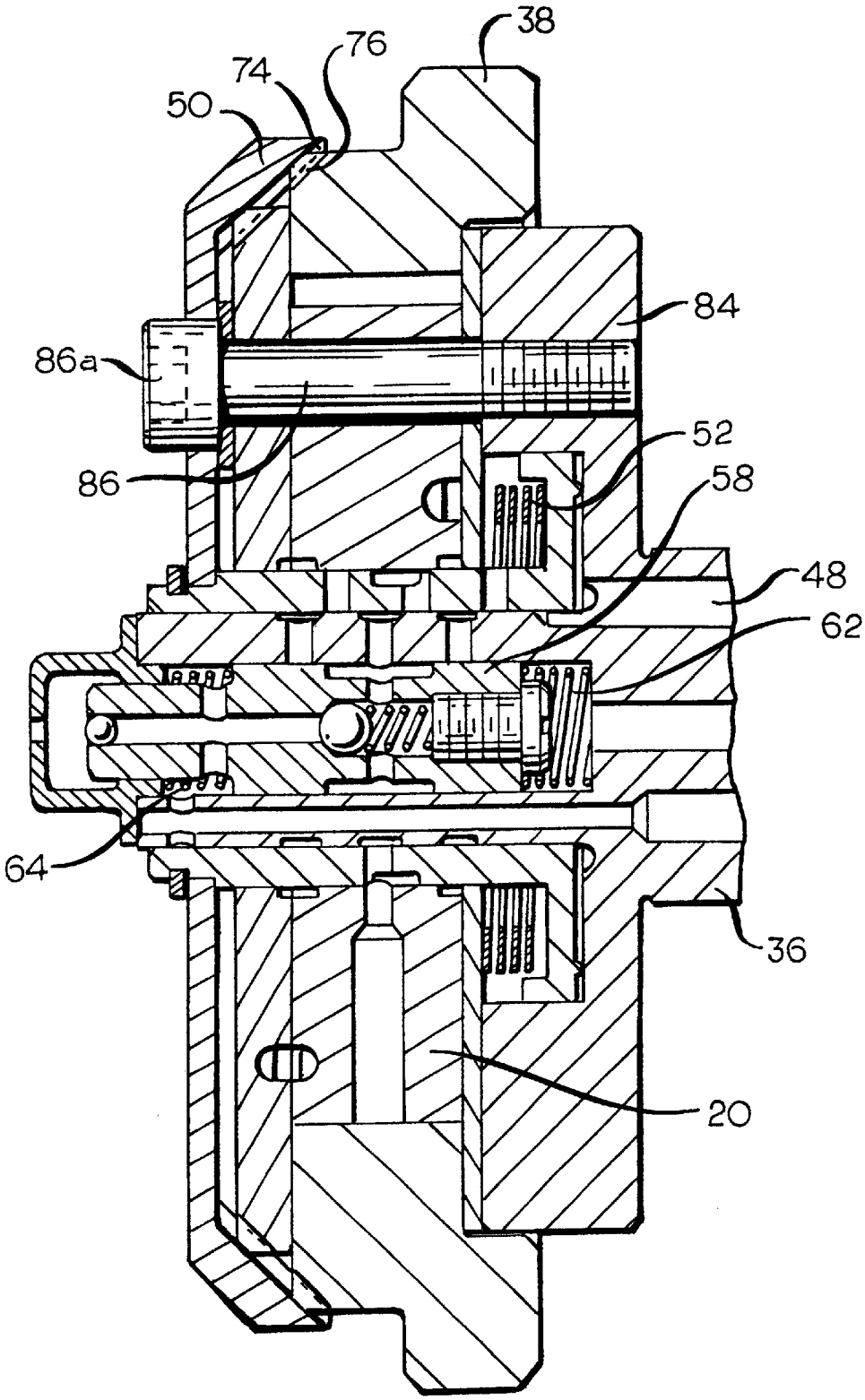
FIG. 6 is a view like FIGS. 2 and 4, in the FIG. 5 condition of the operation of the variable valve timing system of the present invention.

As is shown in FIGS. 2, 4, 6, and 8, the locking plate 50 is in the form of an annular member that is coaxially positioned relative to the longitudinal central axis of the camshaft 36, and the locking plate 50 is provided with an annular array of locking teeth 74 that is positioned to engage an annular array of locking teeth 76 on the housing 28 when the locking plate 50 moves along the longitudinal central axis of the camshaft 36 from the position shown in FIGS. 2 and 4, to the position shown in FIG. 6. As heretofore explained in connection with FIGS. 1, 3, 5 and 7, the locking plate 50 is biased toward its FIG. 4 position by a spring 52, which bears against a radial surface of a slidable annular member 78 to which the locking plate 50 is secured, and the annular member 78 is urged to its position of FIGS. 2, 4 and 8 by hydraulic pressure in the line 48, which bears against a radial surface of the annular member 78 that is opposed to the surface acted on by the spring 52.

Because the locking plate 50 is incapable of circumferential movement relative to the camshaft 36, whereas the housing 28 is capable of circumferential movement relative to the camshaft 36, as heretofore explained, the locking plate 50 is capable of locking the housing in a fixed circumferential position relative to the camshaft 36 at a multitude of relative circumferential positions therebetween, whenever hydraulic pressure in the passage 48 falls below the value needed to overcome the effect of the spring 52.

As is shown in connection with the recess 30 in FIGS. 2, 4, 6 and 8, the housing 28 is open at both its ends and is closed by separate, spaced apart annular plates 80, 82. The assembly that includes the locking plate 50, the plates 80, 82, the housing 28, and the vane 20 is secured to an annular flange 84 of the camshaft 36 by a plurality of bolts 86, each of which passes through one or another of the lobes 22, 24, 26 of the vane 20. In that regard, the locking plate 50 is slidable relative to a head 86*a* of each bolt 86, as can be seen by comparing the relative positions of the locking plate 50 and the bolt 86 in FIGS. 2 and 4, versus their relative positions in FIG. 6.

Figure 10:
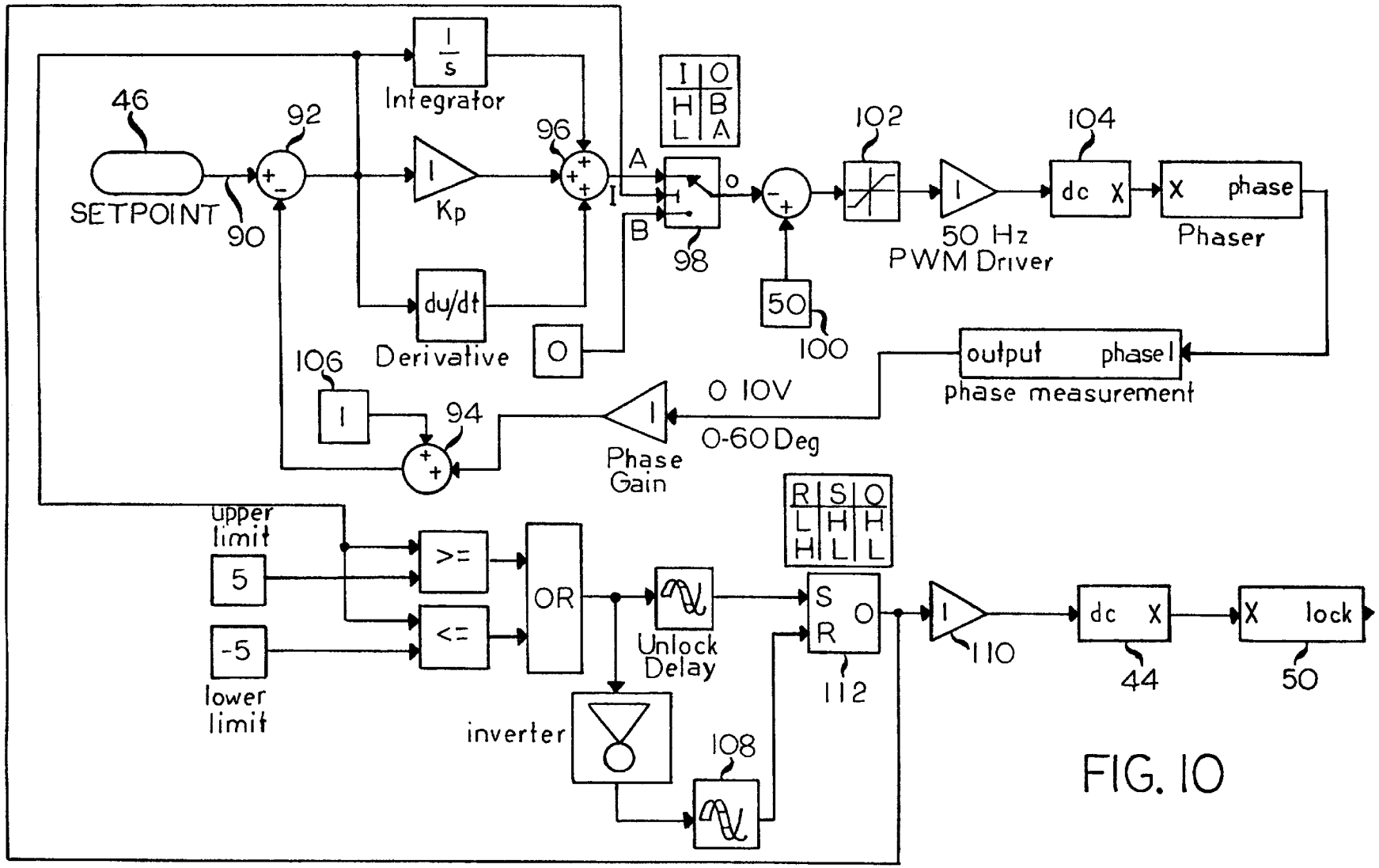
FIG. 10 is a schematic view of a closed loop control system for controlling the operation of the variable value timing system components of FIGS. 1–9.

As is shown in FIG. 10, to control the operation of the variable valve timing device of FIGS. 1–9 according to a closed loop system, a set point 96 from the engine controller 46 goes through a summing junction 92 and is added with the phase signal feedback from a source 94 and becomes a phase error signal (the set point must be in 5-degree increments from 0 to 60 degrees). The error signal goes through a PID controller 97 with separate controls for each and becomes an output signal. The output signal goes through a switch 98 that switches between the output error signal and a present zero value (the zero value is used when the vct is in the locked position). The "null" offset from a source 100 is summed with the error signal and is clipped to a min and max value in a saturation block. The null offset is the percent of DC voltage that is required to maintain the direction valve at its null position. The error signal then goes to a solenoid driver 104 and the solenoid driver 104 controls the pressure to the phaser of FIGS. 1–9. When the phaser of FIGS. 1–9 moves to a new position, a phase measurement board 106 measures this change and provides an output signal. This signal goes back to the set point summing junction 92. The phase measurement signal is altered by a gain and offset setting from a source 106 as needed.

The lock is turned on when the error signal is above or below the preset values. (+/−5 crank degrees in this case.) There is a timer value 108 to delay turning the lock on if needed. The signal then goes to a solenoid driver 110 and then the solenoid driver 110 turns on oil to the lock piston.

Once the phase error signal is within 5 degrees of the set point, the lock delay is activated. A set/reset latch 112 is used to make sure the locking plate 50 is controlled properly. The signal out of the set/reset 112 latch goes to the solenoid driver 110 and activates the solenoid 44.

Figure 11:
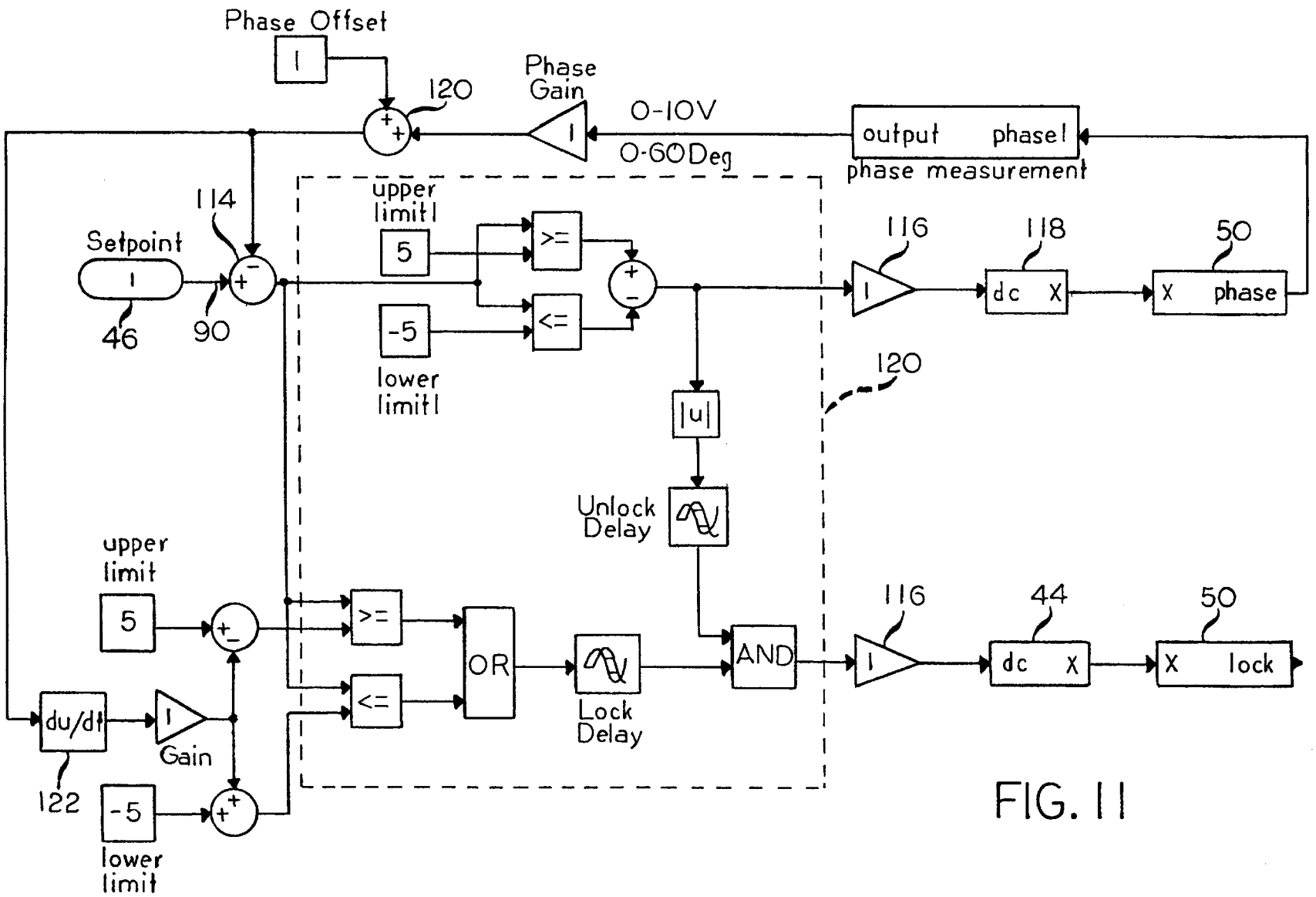
FIG. 11 is a view like FIG. 10 of an open loop control system for controlling the operation of the components of FIGS. 1–9.

As is shown in FIG. 11, to control the operation of the variable valve timing device of FIGS. 1–9 according to an open loop system, a set point from the engine controller 46 goes through a summing junction 114 and is added with the phase signal feedback from a source 120 and becomes the phase error signal (the set point must be in 10 crank degree increments from 0 to 60 degrees). If the error signal is greater than 5 crank degrees from the set point, a directional solenoid driver 116 will be turned off. If the error signal is less than five crank degrees from the set point, the directional solenoid driver 116 will be turned on. An on signal to a directional valve 120 will cause the phaser of FIGS. 1–9 to move towards the advance direction at a fixed rate. At the same time, a lock solenoid 118 is turned on and the locking plate 50 is unlocked. If the error signal is greater than 5 crank degrees from the set point 90, the directional valve 120 will be turned off. An off signal to the directional valve 120 will cause the phaser of FIGS. 1–9 to move towards the retard direction at a fixed rate. Once the error signal is close to the set point the locking plate 50 can be reengaged and the phaser will be locked in position. The derivative of the shift-rate is taken by device 122 so that the time needed to reengage the lock could be determined (oil temperature and pressure affect the shift rate). In FIG. 11, the reengage limits of the locking plate 50 are based on the derivative rather than the reengage time.

The control system of FIG. 11 will work with a slower responding phaser such as a helical spline or vane style phaser that has full stroke actuation rates around 0.5 seconds. The lock response needs to be around 10 times faster than the phaser response. The locking arrangement of FIGS. 1–9 has a response around 0.05 seconds. This control will also work with a "brute force" phaser rather than the "self powered" unit of FIGS. 1–9 because its response is around 0.130 seconds. Another advantage of the systems of FIGS. 1–9. 10 and 11 is that both the lock and shift solenoids can be inexpensive on/off solenoids rather than more expensive proportional type solenoids Although the best mode contemplated by the inventor for carrying out the present invention as of the filing date hereof has been shown and described herein, it will be apparent to those skilled in the art that suitable modifications, variations and equivalents may be made without departing from the scope of the invention, such scope being limited solely by the terms of the following claims and the legal equivalents thereof.

What is claimed is:

1. In an internal combustion engine, a variable camshaft timing system comprising:

a camshaft (36) having a central axis, said camshaft being rotatable about said central axis;

a vane (26) having at least one lobe (22,24 or 26) secured to the camshaft for rotation therewith, said vane being nonoscillatable with respect to the camshaft;

an annular housing (28) surrounding the vane and having at least one recess (30, 32, or 34), the at least one recess having a circumferential extent grater than the circumferential extent of the at least one lobe and receiving the at least one lobe, said annular housing being rotatable with said camshaft and said vane and being oscillatable with respect to said camshaft and said vane;

hydraulic means (56, 58, 68) for causing relative circumferential motion between said housing and said vane; and locking means reactive to hydraulic pressure and movable along said central axis for preventing relative circumferential motion between said housing and said vane at one of a plurality of relative circumferential positions of said housing and said vane during periods of low hydraulic pressure and for permitting said relative motion during periods of higher hydraulic pressure.

2. A variable camshaft timing system according to claim 1 wherein said hydraulic means comprises means reactive to torque pulses in said camshaft.

3. A variable camshaft timing system according to claim 1 wherein said annular housing comprises a first annular array of teeth (76) and wherein said locking means comprises:

an annular locking plate (50), said annular locking plate having a second annular array of teeth (74), said second annular array of teeth being in engagement with said first annular array of teeth in a first position of said annular locking plate to prevent relative circumferential motion between said housing and said vane and being out of engagement with said first annular array of teeth In a second position of said annular locking plate to permit relative circumferential motion between said annular housing and said vane; and resilient means (52) for biasing said annular locking plate to said first position.

4. A variable camshaft timing system according to claim 3 wherein said annular locking plate is coaxially positioned relative to a longitudinal central axis of said camshaft and is moveable along the longitudinal central axis of said camshaft between said first position and said second position.

5. A variable camshaft timing system according to claim 4 wherein said annular locking plate has a radially extending flange (78) and wherein said resilient means engages a radially extending surface of said radially extending flange.

6. A variable camshaft timing system according to claim 5 wherein said locking means further comprises:

a passage (48) extending through said camshaft for delivering a hydraulic supply to said locking means, the hydraulic supply acting against an opposed radially extending surface of said radially extending flange of said annular locking plate to act against a force imposed on said annular locking plate by said resilient means for biasing.

7. A variable camshaft timing system according to claim 6 and further comprising:

an on/off flow control valve (44) for controlling hydraulic flow into said passage extending through said camshaft.

8. A variable camshaft timing system according to claim 7 and further comprising:

an electronic engine control unit (46) for controlling operation of said on/off flow control valve to control whether said control valve operates in an on mode or in an off mode.

9. A variable camshaft timing system according to claim 5 wherein said annular housing is open at spaced apart opposed ends thereof, and further comprising:

first and second spaced apart radially extending plates (80, 82) closing opposed ends, respectively, of said annular housing; and wherein said resilient means is trapped between one (82) of said first and second radially extending plates and said radially extending flange of said annular locking plate.

10. A variable camshaft timing system according to claim 9 wherein said camshaft has a radially extending flange (84), and further comprising;

at least one bolt (86) extending through said annular locking plate, each of said radially extending plates, said at least one lobe, and said radially extending flange of said camshaft to secure said radially extending plate and said vane to said camshaft.

11. A variable camshaft timing system according to claim 10 wherein said annular locking plate is moveable axially relative to said at least one bolt.

12. A variable camshaft timing system according to claim 2 and further comprising:

closed loop control means (FIG. 10) for controlling the operation of said locking means.

13. A variable camshaft timing system according to claim 2 and further comprising:

open loop control means (FIG. 11) for controlling the operation of said locking means.

14. In an internal combustion engine, a variable camshaft timing system comprising:

a rotatable camshaft having a central axis, said camshaft being rotatable about said central axis;

a vane having a circumferentially spaced apart plurality of lobes secured to the camshaft for rotation therewith, said vane being nonoscillatable with respect to the camshaft;

an annular housing surrounding said vane and having a circumferentially spaced apart plurality of recesses, each of said recesses having a circumferential extent greater than a circumferential extent of each of the plurality of lobes and receiving one of said plurality of lobes, said annular housing being rotatable with said camshaft and said vane and being oscillatable with respect to said camshaft and said vane;

hydraulic means for causing relative circumferential motion between said housing and said vane, and locking means reactive to hydraulic pressure and moveable along said central axis for preventing relative circumferential motion between said housing and said vane during periods of low hydraulic pressure and for permitting said relative motion during periods of higher hydraulic pressure.

15. A variable camshaft timing system according to claim 14 wherein said hydraulic means comprises means reactive to torque pulses in said camshaft.

16. A variable camshaft timing system according to claim 14 wherein said annular housing comprises a first annular array of teeth, and wherein said locking means comprises:

an annular locking plate, said annular locking plate having a second annular array of teeth, said second annular array of teeth being in engagement with said first annular array of teeth in a first position of said annular locking plate to prevent relative circumferential motion between said housing and said vane and being out of engagement with said first annular array of teeth in a second position of said annular locking plate to permit relative circumferential motion between said housing and said vane; and resilient means for biasing said annular locking plate to said first position.

17. A variable camshaft timing system according to claim 16 wherein said annular locking plate is coaxially positioned relative to a longitudinal central axis of said camshaft and is moveable along a longitudinal central axis of said camshaft between said first position and said second position.

18. A variable camshaft timing system according to claim 17 wherein said annular locking plate has a radially extending flange and wherein said resilient means engages a radially extending surface of said radially extending flange.

19. A variable camshaft timing system according to claim 18 wherein said locking means further comprises:

a passage extending through said camshaft for delivering a hydraulic supply to said locking means, the hydraulic supply acting against an opposed radially extending surface of said radially extending flange of said annular locking plate to act against a force imposed on said annular locking plate by said resilient means for biasing.

20. A variable camshaft timing system according to claim 19 and further comprising;

an on/off flow control valve for controlling hydraulic flow into said passage extending through said camshaft.

21. A variable camshaft timing system according to claim 20 and further comprising:

an engine control unit for controlling operation of said on/off flow control valve to control whether said control valve operates in an on mode or in an off mode.

22. A variable camshaft timing system according to claim 18 wherein said annular housing is open at first and second opposed ends thereof and further comprising:

first and second spaced apart radially extending plates closing said first and second ends of said annular housing, respectively; and wherein said resilient means is trapped between one of said first and second radially extending plates and said radially extending flange of said annular locking plate.

23. A variable camshaft timing system according to claim 22 wherein said camshaft has a radially extending flange, and further comprising:

a plurality of circumferentially spaced apart bolts extending through said annular locking plate, said radially extending plates, each of said plurality of lobes and said radially extending flange of said camshaft to secure said radially extending plates and said vane to said camshaft.

24. A variable camshaft timing system according to claim 23 wherein said annular locking plate is moveable axially relative to each of said plurality of bolts.

25. A variable camshaft timing system according to claim 14 wherein said plurality of lobes of said vane comprises at least three (3) lobes.

26. A variable camshaft timing system according to claim 15 and further comprising:

closed loop control means for controlling the operation of said locking means.

27. A variable camshaft timing system according to claim 15 and further comprising:

open loop control means for controlling the operation of said locking means.

* * * * *